US012716341B2

(12) United States Patent
Graney, IV et al.

(10) Patent No.: US 12,716,341 B2
(45) Date of Patent: Aug. 25, 2026

(54) NATURAL GAS SYSTEM FOR ON-SITE PROCESSING

(71) Applicants: Patrick C. Graney, IV, Charleston, WV (US); Gouverneur C. M. Graney, Charleston, WV (US); Peter Morcheid, Charleston, WV (US)

(72) Inventors: Patrick C. Graney, IV, Charleston, WV (US); Gouverneur C. M. Graney, Charleston, WV (US); Peter Morcheid, Charleston, WV (US)

(73) Assignee: Nacelle Logistics LLC, Charleston, WV (US)

( * ) Notice: Subject to any disclaimer, the term of this patent is extended or adjusted under 35 U.S.C. 154(b) by 611 days.

(21) Appl. No.: 17/707,491

(22) Filed: Mar. 29, 2022

(65) Prior Publication Data

US 2023/0313659 A1 Oct. 5, 2023

(51) Int. Cl.
*E21B 43/34* (2006.01)
*C10L 3/06* (2006.01)

(52) U.S. Cl.
CPC ..... *E21B 43/35* (2020.05); *C10L 3/06* (2013.01); *C10L 2290/54* (2013.01); *C10L 2290/567* (2013.01)

(58) Field of Classification Search
CPC . E21B 43/35; E21B 43/34; C10L 3/06; C10L 2290/54; C10L 2290/567; C10L 2290/02; C10L 2290/547; C10L 2290/58; C10L 2290/60; C10L 3/106; C10L 3/101
See application file for complete search history.

(56) References Cited

U.S. PATENT DOCUMENTS

| | | | |
|---|---|---|---|
| 4,119,417 | A | 10/1978 | Heki |
| 4,264,338 | A | 4/1981 | Null |
| 4,497,640 | A | 2/1985 | Fournie |
| 4,597,437 | A | 7/1986 | McNabb |
| 4,659,460 | A | 4/1987 | Muller |
| 4,779,677 | A | 10/1988 | Cobb |
| 6,128,919 | A | 10/2000 | Daus |
| 7,223,298 | B2 | 5/2007 | Platt |

(Continued)

FOREIGN PATENT DOCUMENTS

WO WO2013/022501 2/2013

*Primary Examiner* — Dung H Bui
(74) *Attorney, Agent, or Firm* — Kean Miller LLP; Robert Devin Ricci; Taylor Dunne

(57) ABSTRACT

A natural gas processing system is mounted on a mobile platform that is transported to a natural gas source, such as a well. The system supplies natural gas to operate multi-fuel engines for wellfield equipment such as pumps, compressors, and drills. A liquid drain discharges contaminants. A water separator and a particulate filter remove particulate matter and liquid contaminant matter from the natural gas. A thermoelectric generator powered by the natural gas supplies process electricity. A process control monitors and controls the natural gas processing system, including pressure, temperature, moisture, and flow sensors. A gas chromatograph will determine the chemical composition of the natural gas. An emergency shutdown system will halt the process in the event of high liquid levels, a gas leak, fire, or gas composition out of specification, to include: H2S, H2O, Percent Mole Composition (BTU), Pressure, Temperature, and Flow Rate.

18 Claims, 10 Drawing Sheets

(56) References Cited

U.S. PATENT DOCUMENTS 7,252,700 B1 8/2007 Strahan
8,585,869 B1 * 11/2013 Duesel, Jr. ..... C02F 1/048 203/79
9,719,024 B2 8/2017 Young
10,018,027 B2 7/2018 Graney
10,184,300 B2 1/2019 Stegemoeller
10,274,133 B2 4/2019 Kunkel
10,478,756 B2 11/2019 Yancy
10,862,307 B2 12/2020 Cavness
11,149,905 B2 * 10/2021 Wang ..... B01D 53/04
2009/0235992 A1 * 9/2009 Armstrong ..... G01M 3/2807 137/487.5
2010/0186586 A1 * 7/2010 Chinn ..... B01D 53/22 96/10
2010/0230002 A1 * 9/2010 Huang ..... B67D 7/3236 141/94
2010/0236773 A1 * 9/2010 Carson, Jr. ..... E21B 36/00 166/61
2011/0282515 A1 * 11/2011 DeFelice ..... G05B 9/02 700/301
2012/0279213 A1 * 11/2012 Conard ..... F01K 9/003 60/645
2012/0317058 A1 * 12/2012 Abhulimen ..... G06N 20/00 706/2
2013/0008516 A1 * 1/2013 O'Hare ..... F17D 1/00 137/511
2014/0187826 A1 * 7/2014 Worden ..... C12P 7/16 435/296.1
2014/0224118 A1 * 8/2014 Zhou ..... B01D 53/0462 95/1
2015/0211684 A1 * 7/2015 Santos ..... F17C 11/007 137/1
2016/0024409 A1 * 1/2016 Murray, Sr. ..... F02D 19/0647 48/127.3
2016/0133814 A1 * 5/2016 Ghoshal ..... H10N 10/17 136/205
2017/0254188 A1 * 9/2017 Graney, IV ..... E21B 43/34
2017/0363015 A1 * 12/2017 Minto ..... F23N 5/242
2018/0003342 A1 * 1/2018 Kunkel ..... F17C 1/00
2018/0372337 A1 * 12/2018 Walker ..... F28D 20/0034
2019/0032853 A1 * 1/2019 King ..... B67D 7/3272
2020/0225193 A1 * 7/2020 Du ..... F16L 55/32
2020/0309385 A1 * 10/2020 Kozlov ..... F24H 1/107
2022/0090823 A1 * 3/2022 Colburn ..... F24H 15/20
2022/0161998 A1 * 5/2022 Turner ..... B65F 3/201
2022/0260251 A1 * 8/2022 Wang ..... C10L 3/106
2022/0268143 A1 * 8/2022 Fink ..... B01D 19/0042
2023/0058457 A1 * 2/2023 Graney, IV ..... B01D 53/226
2023/0123358 A1 4/2023 Brown et al.
2023/0340863 A1 * 10/2023 Pickernell ..... E21B 43/128

* cited by examiner

NATURAL GAS SYSTEM FOR ON-SITE PROCESSING

TECHNICAL FIELD

The presently disclosed technologies are directed to an apparatus and method that processes natural gas, and in particular, a transportable apparatus for processing natural gas at the wellhead.

BACKGROUND

It is often uneconomical or impractical to capture and transport natural gas in a special pipeline from the wellhead to a refinery. In these cases the gas is flared off, or burned. It is thus wasted, both as a source of energy and as a valuable commodity.

In those instances where a pipeline is built, other problems develop. Natural gas at the wellhead usually contains impurities such as carbon dioxide ($CO_2$), and hydrogen sulfide ($H_2S$). When dissolved in water, $CO_2$ is known as carbonic acid. Similarly, $H_2S$ becomes hydrosulfuric acid. Either of these acids will cause corrosion problems in pipelines and related equipment during transportation of natural gas.

The natural gas product at retail comprises almost pure methane, but source natural gas from the wellhead contains a variety of contaminants. In addition to the $CO_2$ and $H_2S$, other gases such as nitrogen and carbon dioxide may be found in oil and gas wells. Solid impurities include sand and dirt from the reservoir; and scale and corrosion products from the piping. The wells produce a mixture of hydrocarbon gas, condensate, or oil; and water with dissolved minerals such as salt. The oil and gas is processed to separate these components.

Some limited processing of source natural gas is often carried out at the well site. However, the complete processing of natural gas is typically carried out at a centralized process plant, or refinery. Gas from the wellhead is transported by pipeline or tanker vehicle to the refinery.

There are benefits for oil and gas companies to utilize natural gas on site to power engines, rather than trucking in diesel fuel or gasoline. Such engines, for example, would power drilling rigs or pump trucks during fracking. Using refined products, such as LNG or CNG, requires offsite processing, trucking and specialized equipment to deliver the fuel to the site. On site natural gas is source or field gas from a well or pipeline. The benefits include cost savings, employee safety, and less environmental disturbance.

Natural gas engines maintain the best performance and require the least maintenance when utilizing a dry, consistent BTU gas delivered at an optimal pressure and temperature. Various engine manufacturers spec different ideal BTU ranges but typically 1000 to 1100 BTU is the prime range that balances horsepower required to do the job with engine and exhaust heat that causes engine and maintenance issues. It is not economical to develop a pipeline infrastructure to a well pad for pre-processed gas to power engines.

Accordingly, there is a need to provide a system that is transportable to the wellhead site, and that is self-contained, and is capable of processing of source natural gas of varying quality found at the natural gas source.

There is a further need to provide a system of the type described, and that can remove water and particulate contaminants.

There is a still further need to provide a system of the type described, and that is capable of being powered by fuels recovered at the wellhead, and of providing fuels of adequate quality to power hybrid fuel engines on site.

There is a yet further need to provide a system of the type described, and that needs no air compressor to operate instruments and control valves.

SUMMARY

In one aspect, a natural gas processing system is used in connection with a natural gas source and raw source natural gas produced by the source. The natural gas processing system comprises a mobile platform that can be transported to the natural gas source. A liquid drain is juxtaposed with the mobile platform for discharging liquid contaminants from the natural gas processing system. A source natural gas valve is connected in fluid communication with the natural gas source for controlling the source natural gas entering the natural gas processing system.

A water separator is mounted on the mobile platform, and is connected in fluid communication with the source natural gas valve. The water separator is connected to the liquid drain. The water separator removes water liquid from the natural gas. The water separator allows passage of the natural gas through the water separator.

A particulate filter is mounted on the mobile platform, and is connected in fluid communication with the water separator and the liquid drain. The particulate filter removes particulate matter from the natural gas. The particulate filter allows passage of the natural gas through the particulate filter.

At least one natural gas outlet valve is connected in fluid communication with the particulate filter, and controls the natural gas exiting the natural gas processing system. At least one natural gas outlet is connected in fluid communication with the outlet valve.

In another aspect, a natural gas processing system is used in connection with a natural gas source and raw source natural gas produced by the source. The natural gas processing system comprises a mobile platform that can be transported to the natural gas source. A liquid drain is juxtaposed with the mobile platform for discharging liquid contaminants from the natural gas processing system. A source natural gas inlet is connected in fluid communication with the natural gas source. A source natural gas valve is connected in fluid communication with the natural gas source and controls the source natural gas entering the natural gas processing system.

A water separator is mounted on the mobile platform, and is connected in fluid communication with the source natural gas valve. The water separator is connected to the liquid drain. The water separator removes water liquid from the natural gas. The water separator allows passage of the natural gas through the water separator.

A particulate filter is mounted on the mobile platform, and is connected in fluid communication with the water separator and the liquid drain. The particulate filter removes particulate matter from the natural gas. The particulate filter allows passage of the natural gas through the particulate filter.

A high natural gas outlet is connected in fluid communication with the particulate filter, and controls the natural gas pressure at a predetermined pressure as the gas exits the natural gas processing system. A high natural gas outlet valve is connected in fluid communication with the high natural gas outlet.

A low natural gas outlet is connected in fluid communication with the particulate filter, and controls the natural gas pressure at a pressure less than the predetermined pressure as the gas exits the natural gas processing system. A low natural gas outlet valve is connected in fluid communication with the low natural gas outlet.

A thermoelectric generator is mounted on the mobile platform, and supplies process electricity to the natural gas processing system. The thermoelectric generator is powered by the natural gas.

A process control is operatively connected to the natural gas processing system, and to the thermoelectric generator, for controlling the natural gas processing system.

An emergency shutdown valve is connected in fluid communication with the natural gas outlet. At least one emergency shutdown control is operatively connected to the emergency shutdown valve and to the process control.

In still another aspect, a method is disclosed for processing natural gas through a natural gas processing system. The method is used in connection with a natural gas source and raw source natural gas produced by the source. The method comprises providing a mobile platform and adapting the mobile platform for transporting to the natural gas source.

Mounting a water separator on the mobile platform, and connecting a source natural gas valve in fluid communication with the water separator and the natural gas source. Controlling the source natural gas entering the water separator with the source natural gas valve. Allowing passage of the natural gas through the water separator. Removing water liquid from the natural gas with the water separator, and draining the water liquid from the water separator through a liquid drain.

Mounting a particulate filter on the mobile platform, connecting the particulate filter in fluid communication with the water separator, and allowing passage of the natural gas through the particulate filter. Removing particulate matter from the natural gas with the particulate filter, and allowing water to drain from the particulate filter through the liquid drain.

Connecting a high natural gas outlet in fluid communication with the particulate filter, and controlling the natural gas pressure at a predetermined pressure exiting the natural gas processing system through the high natural gas outlet.

Connecting a low natural gas outlet in fluid communication with the particulate filter, and controlling the natural gas pressure at a pressure less than the predetermined pressure exiting the natural gas processing system through the low natural gas outlet.

Mounting a thermoelectric generator on the mobile platform, supplying process electricity with the thermoelectric generator, and powering the thermoelectric generator with the natural gas.

Operatively connecting a process control to the natural gas processing system and to the thermoelectric generator, and controlling the natural gas processing system with the process control.

Connecting an emergency shutdown valve in fluid communication with the natural gas outlet, operatively connecting at least one emergency shutdown control to the emergency shutdown valve and to the process control, so as to shut down the natural gas processing system in the event of an emergency.

These and other aspects, objectives, features, and advantages of the disclosed technologies will become apparent from the following detailed description of illustrative embodiments thereof, which is to be read in connection with the accompanying drawings.

It should be noted that the drawings herein are not to scale.

DETAILED DESCRIPTION

Describing now in further detail these exemplary embodiments with reference to the Figures as described above, the natural gas processing system is typically used to process natural gas sourced from a well or a pipeline. However, the source is non-limiting, and can be a truck tanker, a marine tanker, a stationary storage tank, or any source.

As used herein, a "processing assembly" or "processing system" refers to one or more devices used to condition or transform or process natural gas into another form or product.

As used herein, "natural gas" refers to raw source natural gas, or refined natural gas, or a gaseous fuel product in any stage of processing from the source to the finished product ready to ship. As used herein, "source gas" refers to raw natural gas or field gas as it comes directly from the wellhead.

As used herein, the term "process" refers to a procedure of moving or transporting a raw source natural gas, or a refined natural gas, or a gaseous fuel product, and converting the natural gas into a gaseous fuel product in any stage of processing. The "flow path" is the conduit through which the natural gas moves during the process. The natural gas moves in a "process direction" along the flow path, shown by arrows.

As used herein, "particulate" is defined as solid or liquid contaminant matter. A "particulate filter" removes entrained mists and oils. An example is a Xebec® coalescing type filter. This example is non-limiting.

As used herein, "water separator" is an apparatus that removes liquid or vapor water contaminants from the gas stream. An example is a Xebec® water separator liquid removal tank. This example is non-limiting.

As used herein, "pressure control valve" is a pressure regulator.

As used herein, "flame detector" is an instrument that senses a flame or heat signature indicating a fire due to gas leak or an electrical short in the system that is potentially dangerous. Flame detector includes an infrared sensor.

As used herein, "methane detector " is an instrument that senses a gas leak in the system that is potentially dangerous.

Figure 9:
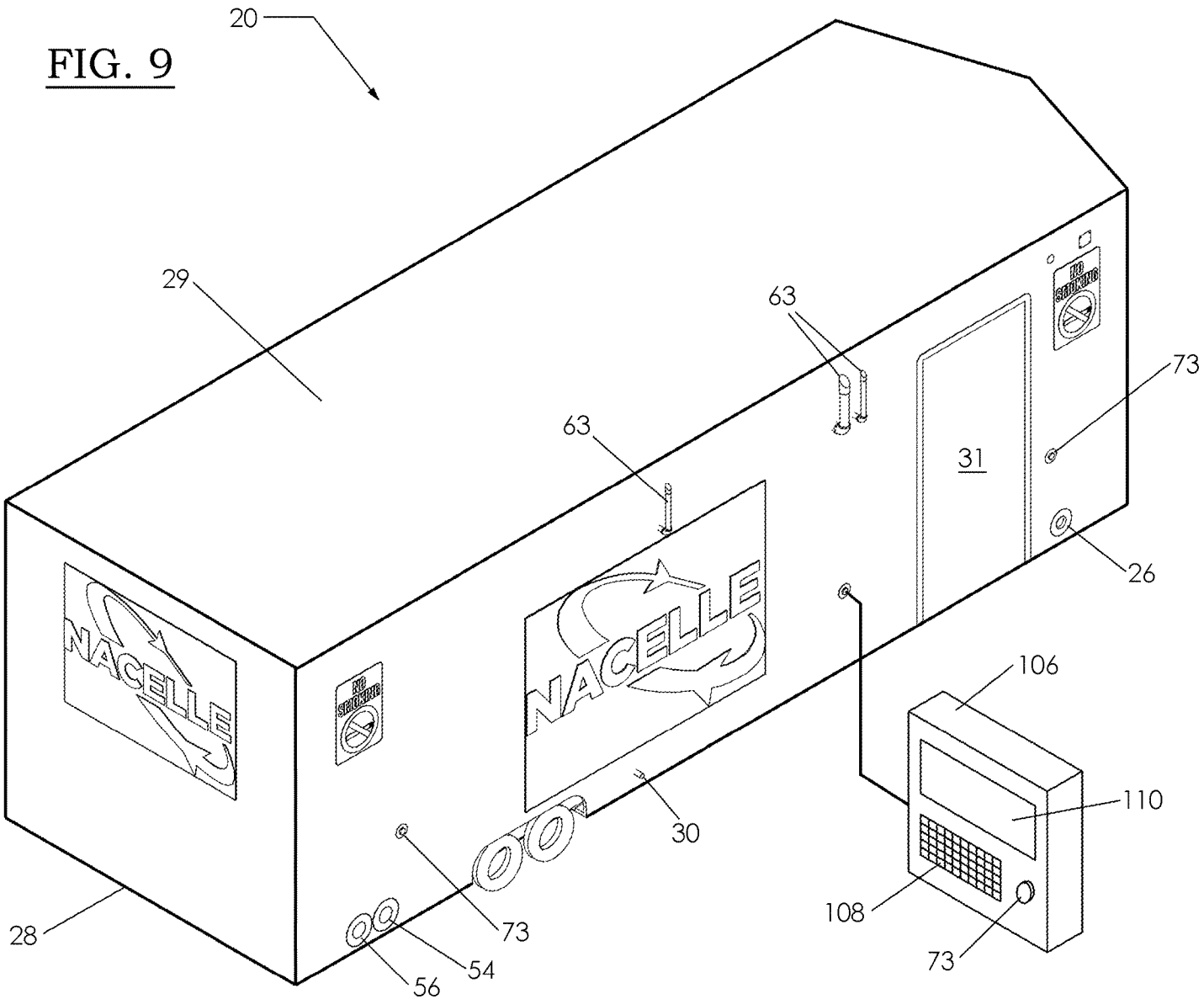
FIG. 9 is a right side perspective view of the enclosure for the natural gas processing system of FIG. 1.
Figure 10:
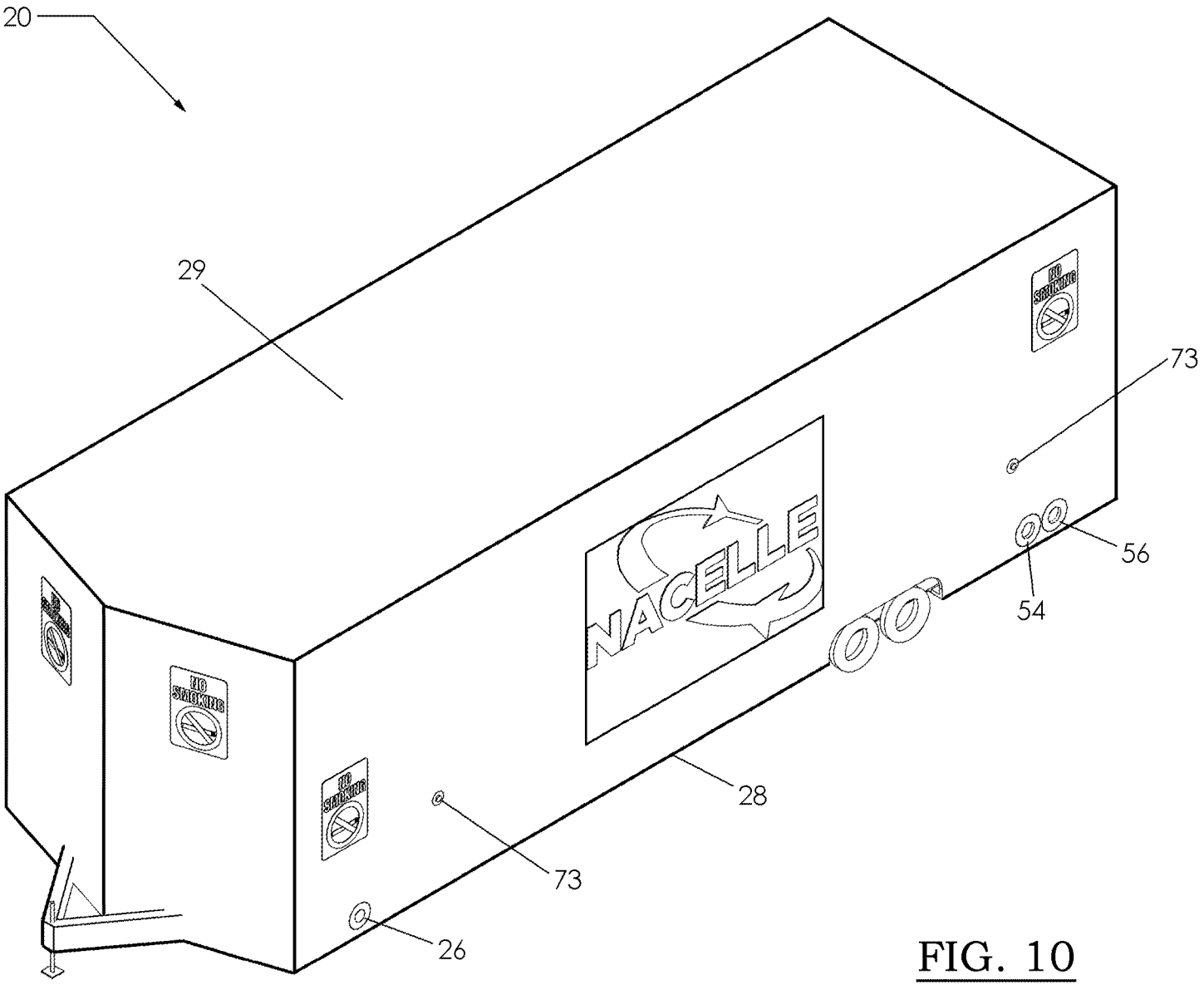
FIG. 10 is a left side perspective view of the enclosure for the natural gas processing system of FIG. 1.

Energy companies benefit by using natural gas at the well head, rather than diesel fuel, to power engines for on-site processes such as drilling, pumping various fluids, and for electricity. This results in cost savings, worker safety, and environmental protection. This disclosure is one embodiment of the invention that conditions natural gas from the well head for use in these multi-fuel engines. Referring to the drawing figures, a natural gas processing system is shown at 20. The system 20 is used in connection with a natural gas source 22 (not shown) which typically comprises, but is not limited to, a natural gas well or a natural gas pipeline. Raw source natural gas 24 (not shown) is produced by the source 22. The natural gas 24 enters the system through natural gas inlet 26. The natural gas processing system 20 comprises a mobile platform 28 that can be transported to the natural gas source 22. The mobile platform 28 is typically a trailer or a skid, but is not limited to these structures. The mobile platform 28 can be any structure capable of receiving and mounting equipment and of being transported to the site of the natural gas source 22. FIGS. 1-5 show a trailer mobile platform 28. FIGS. 9-10 show the trailer mobile platform 28 with an enclosure 29, comprising a box trailer with access doors 31.

Turning to the drawing FIGS. 1-5, a liquid drain 30 is juxtaposed with the mobile platform 28 for discharging liquid contaminants from the natural gas processing system 20. The liquid drain 30 is also found on major components throughout the system. A source natural gas inlet 26 is connected in fluid communication with the natural gas source 22. A source natural gas valve 36 is connected in fluid communication with the natural gas source 22 and controls the source natural gas 22 entering the natural gas processing system 20.

A water separator 32 is mounted on the mobile platform 28, and is connected in fluid communication with the source natural gas valve 36. The water separator 32 is connected to the liquid drain 30. The water separator 32 removes water liquid from the natural gas 24. The water separator 32 allows passage of the natural gas 24 through the water separator 32.

A particulate filter 46 is mounted on the mobile platform 28, and is connected in fluid communication with the water separator 32 and the liquid drain 30. The particulate filter 46 removes particulate matter from the natural gas 24. The particulate filter 46 allows passage of the natural gas 24 through the particulate filter 46. The particulate filter 46 has a particulate filter bypass valve 50 for vessel maintenance.

At least one natural gas outlet valve is connected in fluid communication with the particulate filter for controlling the natural gas exiting the natural gas processing system. At least one natural gas outlet is connected in fluid communication with the outlet valve.

In the preferred embodiment, the gas flow will split, after the particulate filter 46, into two streams. A high natural gas outlet 56 is connected in fluid communication with the particulate filter 46, and controls the natural gas pressure at a predetermined pressure as the gas exits the natural gas processing system 20. A high natural gas outlet valve 88 is connected in fluid communication with the high natural gas outlet 56.

A low natural gas outlet 54 is connected in fluid communication with the particulate filter 46, and controls the natural gas pressure at a pressure less than the predetermined pressure as the gas exits the natural gas processing system 20. A low natural gas outlet valve 86 is connected in fluid communication with the low natural gas outlet 54.

A process control 66 is operatively connected to the natural gas processing system 20, and to the thermoelectric generator 64, for controlling the natural gas processing system 20. The process control 66 receives data from the plurality of temperature, pressure, gas, and flow measuring sensors operatively connected to the process control.

An emergency shutdown valve 72 is connected in fluid communication with the natural gas outlets 54, 56. At least one emergency shutdown control 71 is operatively connected to the emergency shutdown valve 72 and to the process control 66. The emergency shutdown control and valve is monitored by the process control 66.

A high flow sensor 60 is connected in fluid communication with the high natural gas outlet 56. A low flow sensor 58 is connected in fluid communication with the low natural gas outlet 54. The high 60 and low 58 flow sensors are operatively connected to the process control 66.

A high temperature sensor 81 is connected in fluid communication with the high natural gas outlet 56. A low temperature sensor 80 is connected in fluid communication with the low natural gas outlet 54. The high 81 and low 80 temperature sensors are operatively connected to the process control 66.

Figure 1:
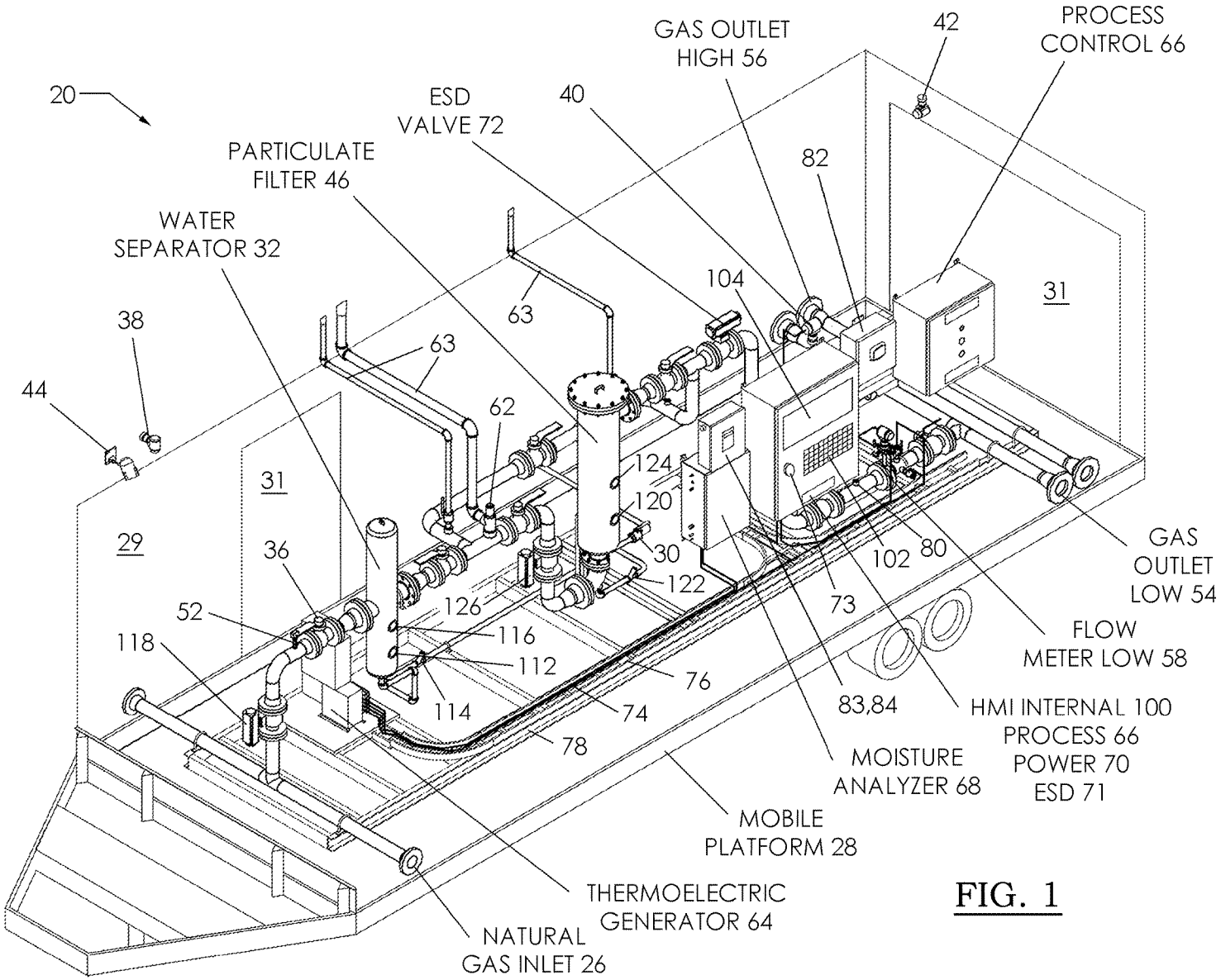
FIG. 1 is a left side perspective view of a natural gas processing system constructed in accordance with the invention, with the mobile platform enclosure partially removed.
Figure 2:
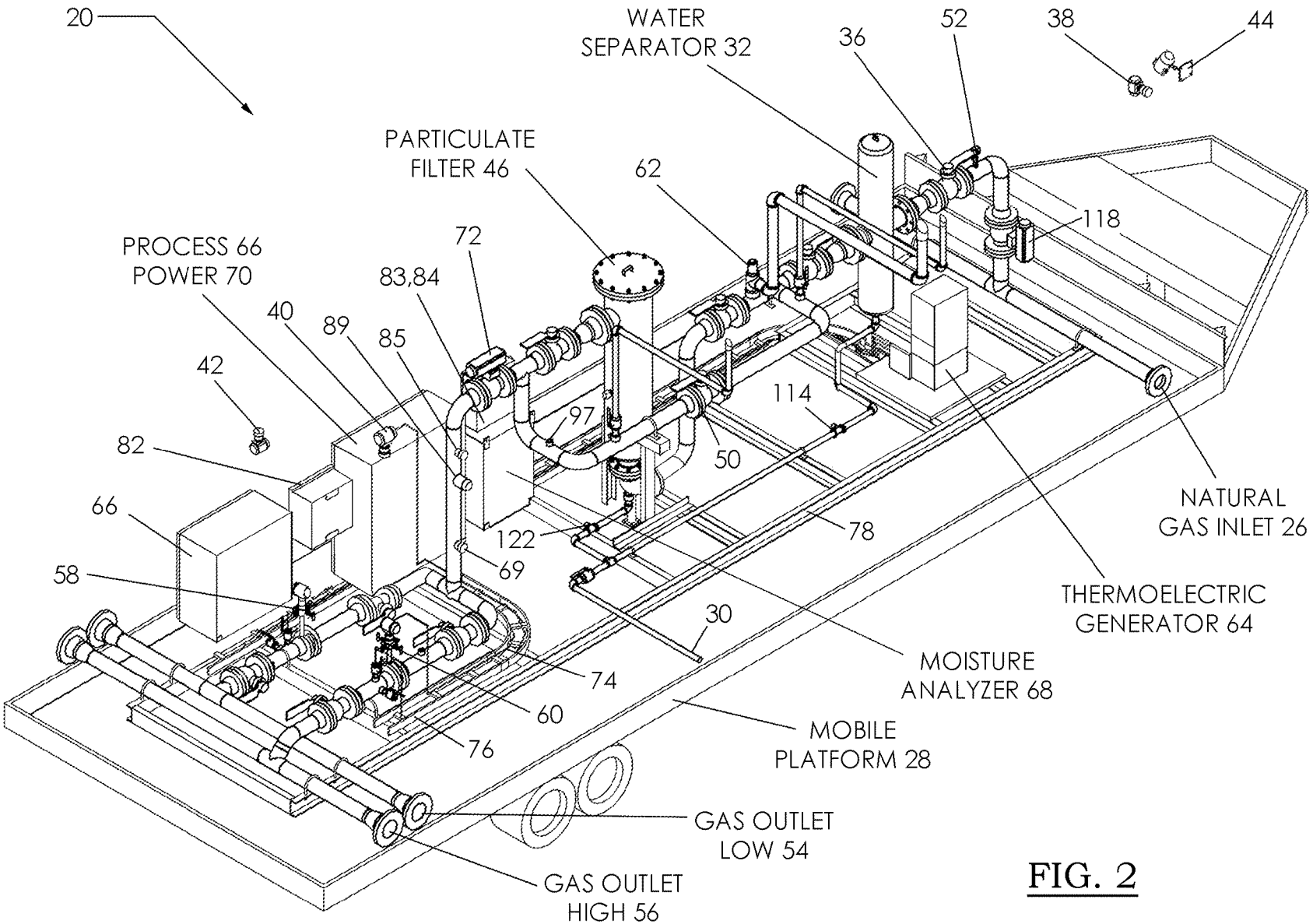
FIG. 2 is a right side perspective view of the natural gas processing system of FIG. 1, with the mobile platform enclosure removed.
Figure 3:
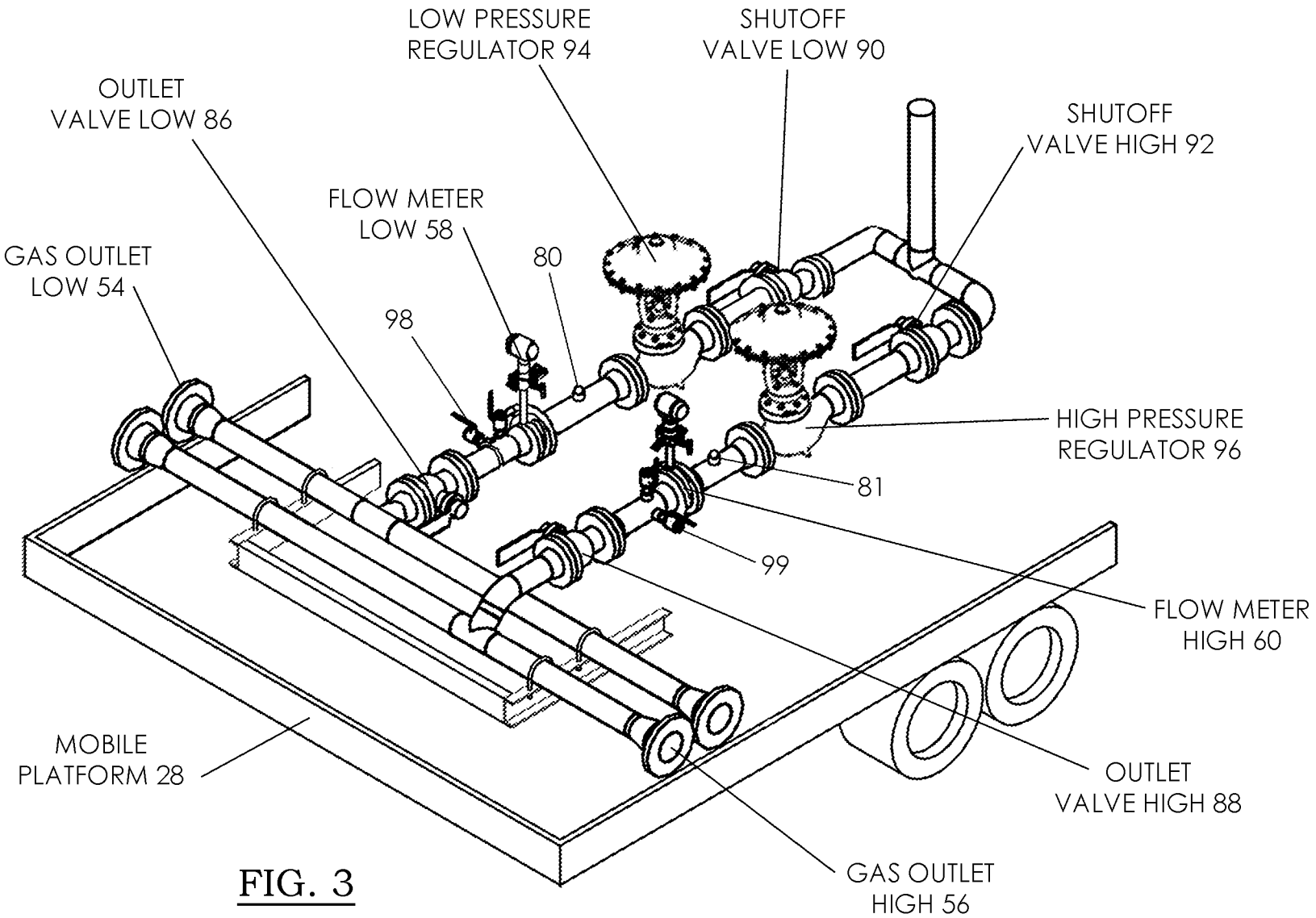
FIG. 3 is a right side perspective view of a rear portion of the natural gas processing system of FIG. 1, with the mobile platform enclosure removed.
Figure 4:
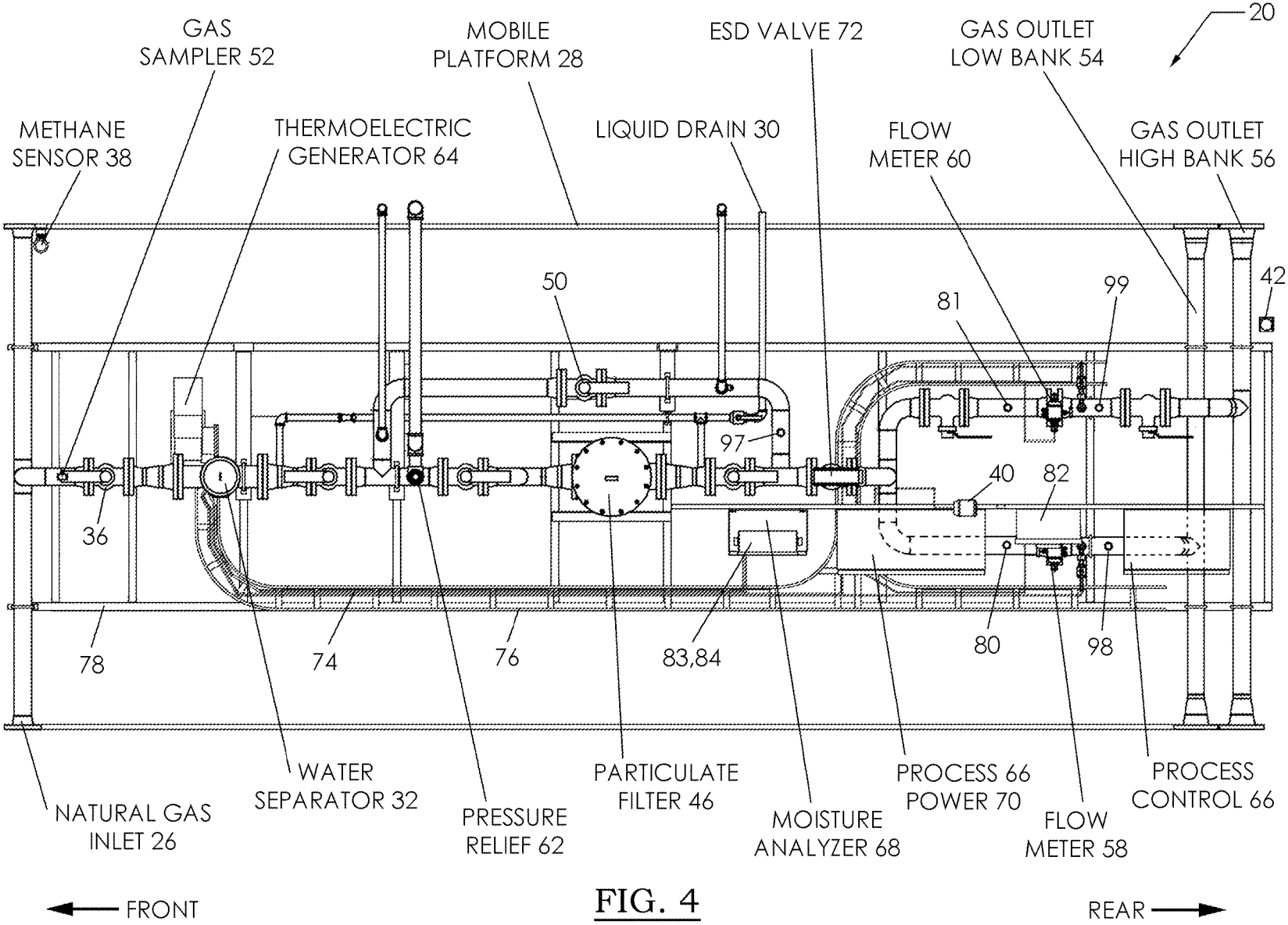
FIG. 4 is a top plan view of the natural gas processing system of FIG. 1, with the mobile platform enclosure removed.
Figure 5:
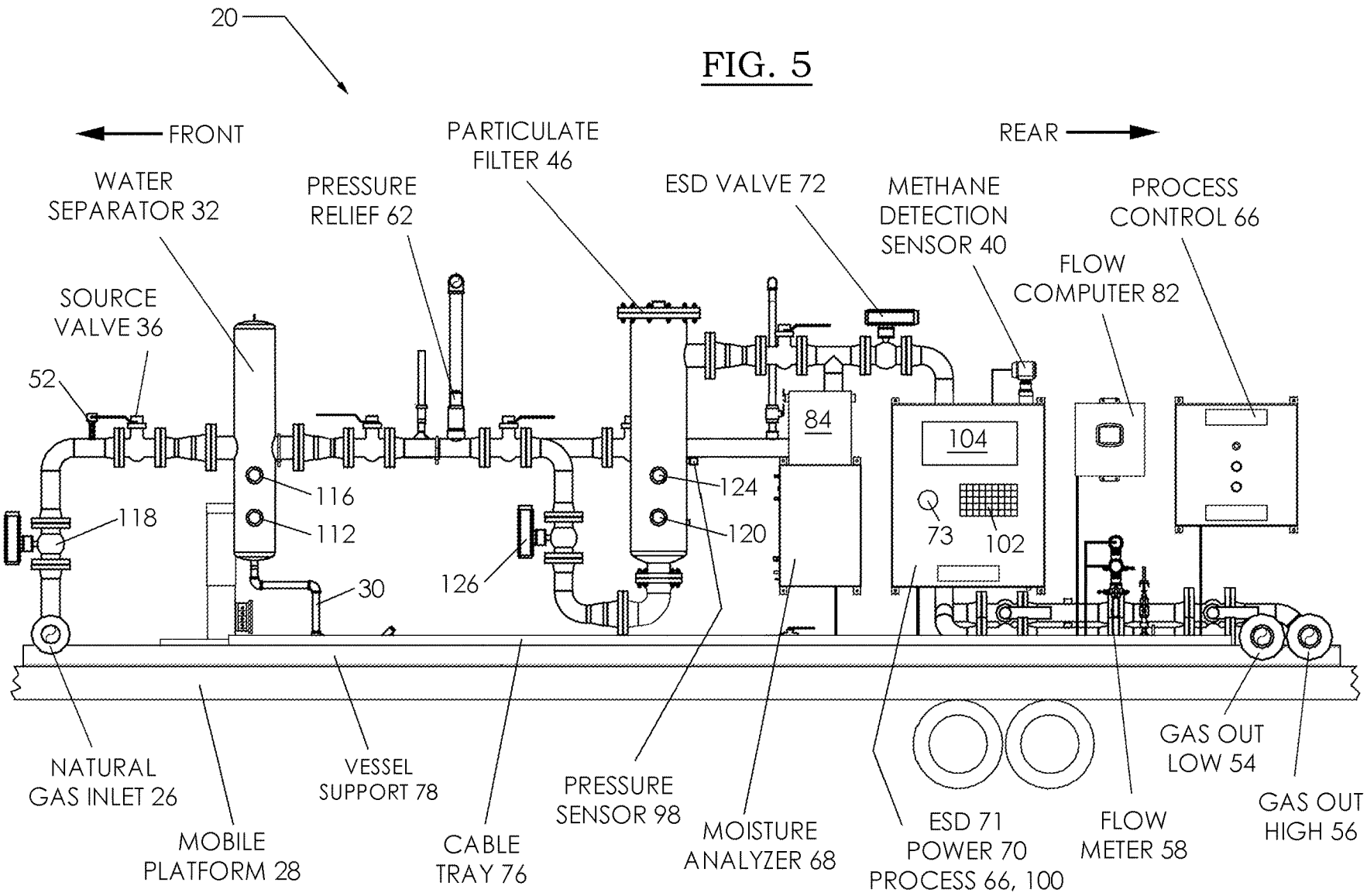
FIG. 5 is a left side elevational view of the natural gas processing system of FIG. 1, with the mobile platform enclosure removed.
Figure 6:
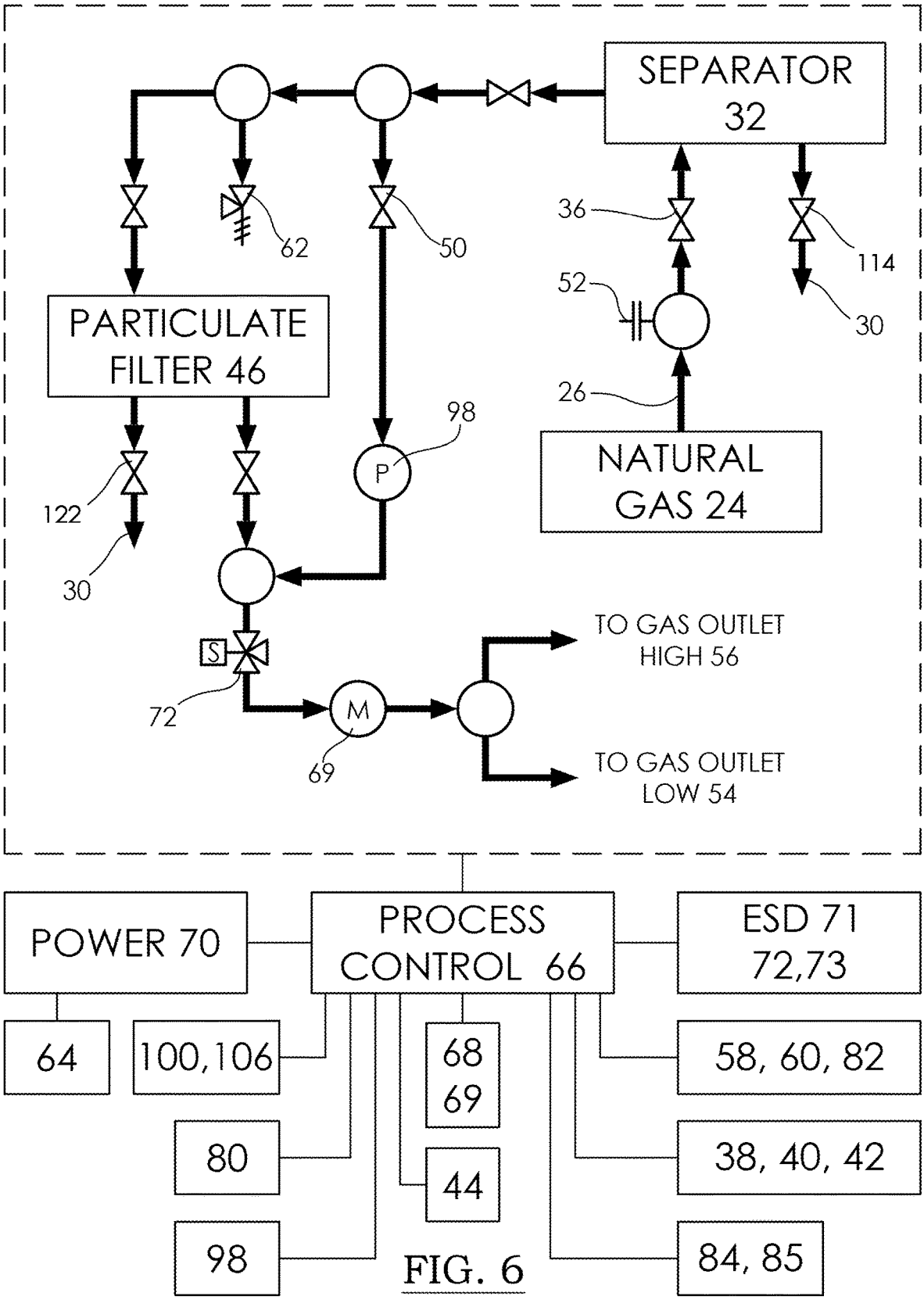
FIG. 6 is a block diagram of the natural gas processing system of FIG. 1, showing the gas flow from the inlet to the outlet.
Figure 7:
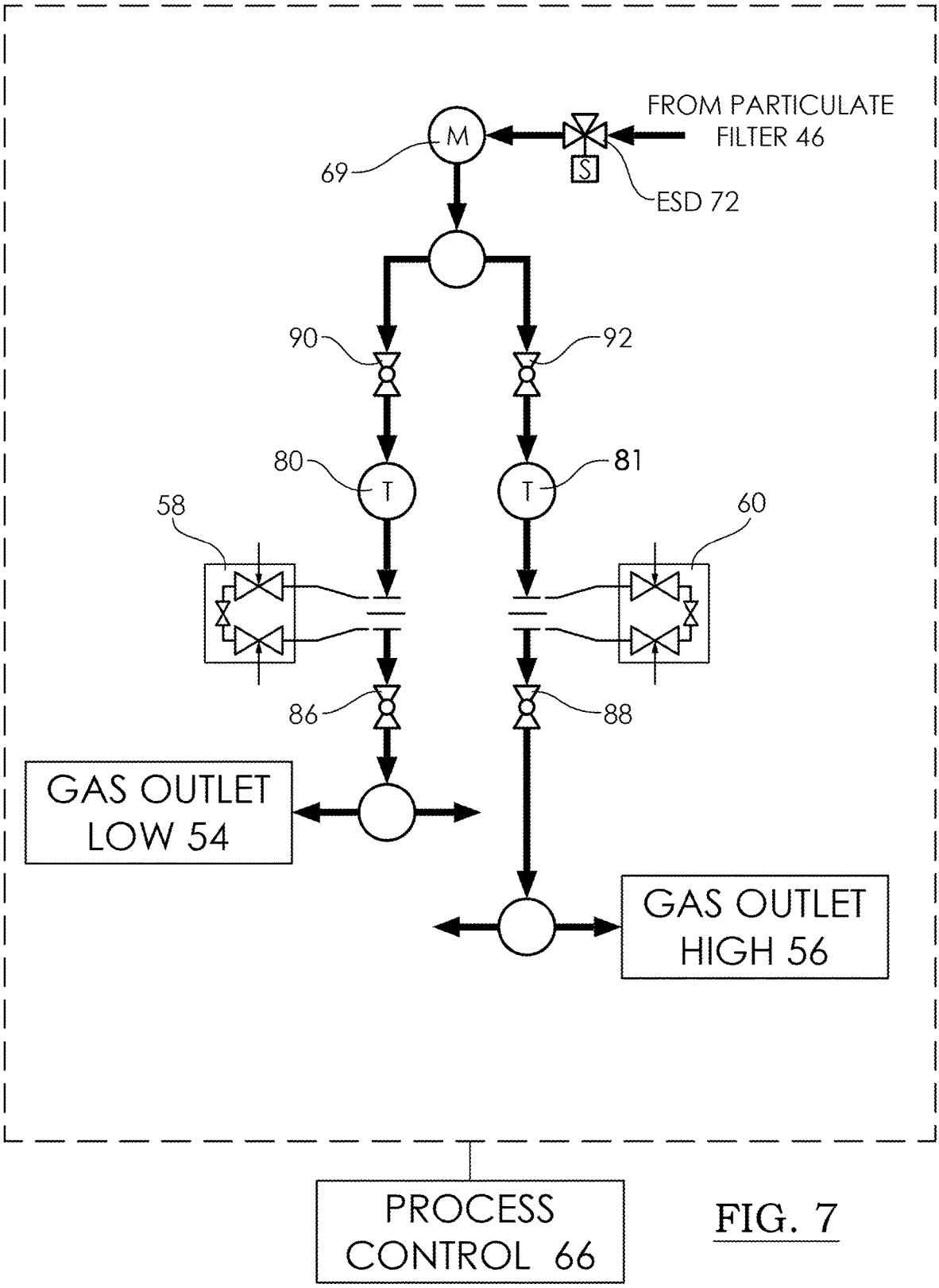
FIG. 7 is a block diagram of the natural gas processing system of FIG. 1, showing the gas flow from the ESD valve to the outlet, without pressure regulators.
Figure 8:
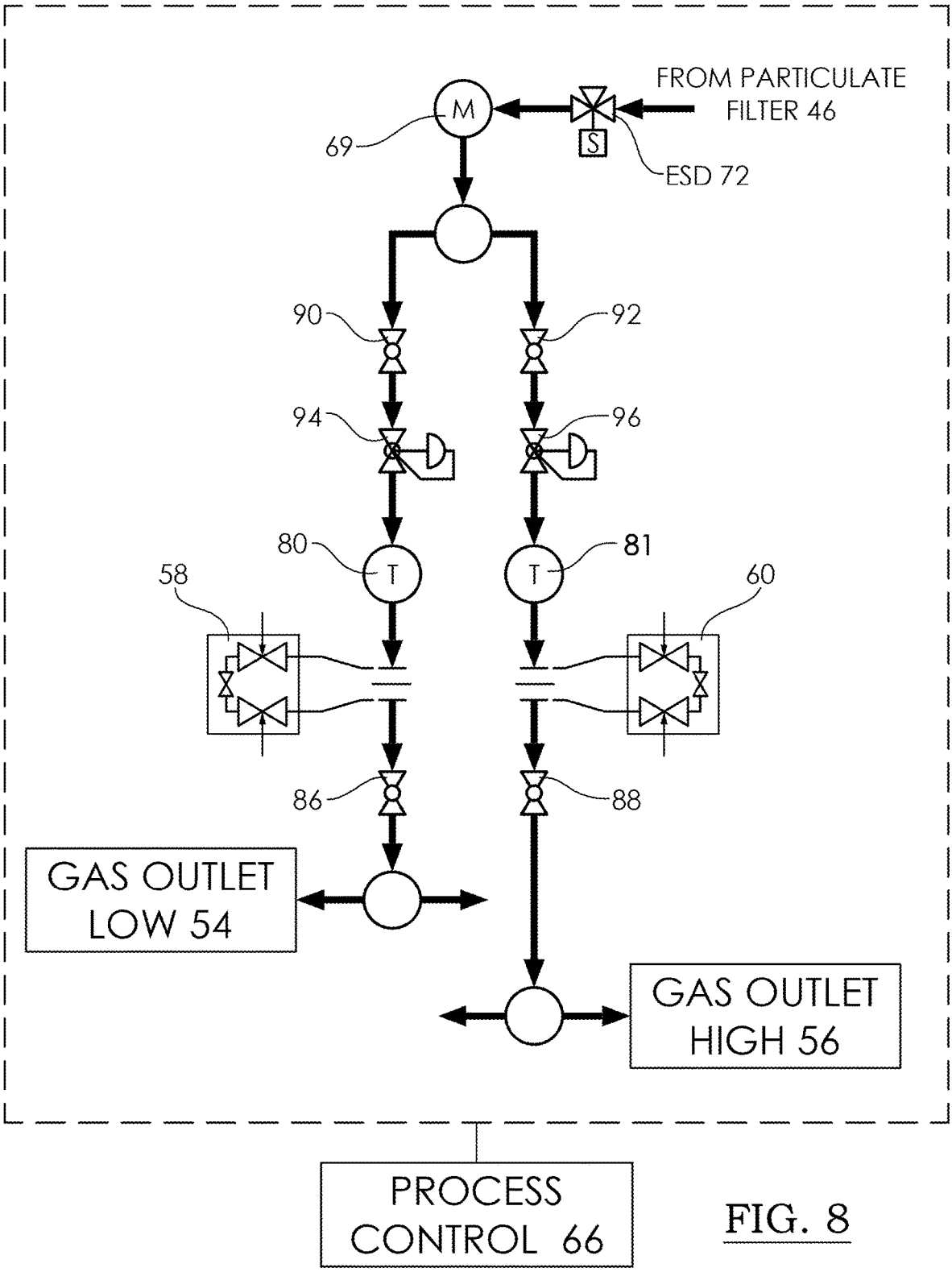
FIG. 8 is a block diagram of the natural gas processing system of FIG. 1, showing the gas flow from the ESD valve to the outlet, with pressure regulators.

Typically, one pressure sensor upstream 97 is connected to the bypass piping around the particulate filter 46, and upstream of the gas flow split, as shown in FIG. 2. Optionally, two pressure sensors can be employed. FIG. 3 shows a high pressure sensor 99 connected in fluid communication with the high natural gas outlet 56. A low pressure sensor 98 is connected in fluid communication with the low natural gas outlet 54. The high 99 and low 98 pressure sensors are downstream of the gas flow split, and are operatively connected to the process control 66.

As an option, one or more pressure regulators may be utilized. FIG. 3 shows a high pressure regulator 96 is connected in fluid communication with the high natural gas outlet 56. A low pressure regulator 94 is connected in fluid communication with the low natural gas outlet 54.

At least one gas sensor 85 is connected in fluid communication with the natural gas outlet 54, 56. The gas sensor 85 is operatively connected to the emergency shutdown control 71 for direct emergency shutdown, in the event that any gas composition parameters should exceed programmed limits. A gas analyzer 84 is operatively connected to the gas sensor 85 and to the process control 66. The gas analyzer will determine the chemical composition of the natural gas 24, and will convey the data to the process control 66. The gas analyzer is preferably a gas chromatograph, but this is understood to be non-limiting, as any type of gas analyzer can be used.

An H2S sensor 89 is connected in fluid communication with the natural gas outlet 54, 56. The H2S sensor 89 is operatively connected to the emergency shutdown control 71 for direct emergency shutdown, in the event that any H2S parameters should exceed programmed limits. An H2S analyzer 83 is operatively connected to the H2S sensor 89 and to the process control 66. The H2S analyzer will determine the H2S composition of the natural gas 24, and will convey the data to the process control 66.

At least one moisture sensor 69 is connected in fluid communication with the natural gas outlet. The moisture sensor 69 is operatively connected to the emergency shutdown control 71 for direct emergency shutdown, in the event that moisture levels should exceed programmed limits. A moisture analyzer 68 is operatively connected to the moisture sensor 69 and to the process control 66. The moisture analyzer 68 will determine the presence and quantity of water and other liquid particle contaminants.

A thermoelectric generator 64 is mounted on the mobile platform 28, and supplies process electricity to the natural gas processing system 20. The thermoelectric generator 64 is powered by the natural gas 24, which is supplied to the thermoelectric generator 64 at approximately 1695 SCFD and 15-25 PSIG.

Instruments are provided that monitor conditions inside the enclosure 29 and signal the presence of flammable gas or flame. In the preferred embodiment, a first methane detector 38, a second methane detector 40, and a third methane detector 42 will detect a methane leak, and alert the emergency shutdown control 71. Similarly, a flame detector 44 will detect any heat signature, and alert the emergency shutdown control 71. The flame detector 44 preferably will be an infrared sensing device, but this is understood to be non-limiting, and any flame detector can be utilized.

HMI (human-machine interface) cabinets include a HMI internal cabinet 100 mounted on the mobile platform 28. A HMI external cabinet 106 is mounted outside of the mobile platform 28, at any desired distance away, and is connected by a cable, although a wireless connection is an option. The HMI internal 100 cabinet includes a keyboard 102 to input commands, and a monitor 104 to display data. The HMI external 106 cabinet is substantially a duplicate, and includes a keyboard 108 to input commands, and a monitor 110 to display data. The HMI will monitor system parameters in real time.

The process control 66 includes at least a central processor, a memory, and input and output connections. Input signals are received from instruments, sensors, and detectors throughout the system. The sensors and detectors are connected by cables to the process control 66, although wireless connections is an option. Input signals comprise temperature, pressure, and flow at various critical points of the system. Input signals further comprise electrical voltage and current. Control logic is programmed to monitor the entire process and is able to provide operator ease of use and real time process status updates.

Output signals are sent to the HMI internal 100, and to the HMI external 106, and the emergency shutdown control 71. Shutdown can be initiated from the HMI internal 100 or the HMI external 106. Shutdown can also be initiated manually from ESD switches 73 located on the outside of the mobile platform enclosure 29. ESD switches 73 are also located on the HMI internal 100, and HMI external 106 cabinets. Shutdown can further be initiated automatically by input from any one of the first methane detector 38, the second methane detector 40, the third methane detector 42, or the flame detector 44.

Level indicators, typically sight glass windows, on the water separator 32, and on the particulate filter 46 vessels allow operators to monitor the amount of liquid contaminants that have accumulated. The present disclosure provides automatic means for detecting water levels in the water separator 32 and in the particulate filter 46, and draining the liquid contaminants.

A first liquid level sensor 112 is connected in fluid communication with the water separator 32, and senses a first predetermined liquid level in the water separator. The first liquid level sensor 112 is operatively connected to the process control 66 for sending data to the process control.

A first control valve 114 is connected in fluid communication with the water separator 32 and the liquid drain 30. The first control valve 114 is operatively connected to the process control 66 and is responsive to data sent from the first liquid level sensor 112 to the process control 66. When the first predetermined liquid level is reached, the process control 66 will open the first control valve 114 to drain liquid contaminants from the water separator. Natural gas 24 will continue to flow through the system during the draining process.

A second liquid level sensor 116 is connected in fluid communication with the water separator 32 and senses a second predetermined liquid level in the water separator 32 that is higher than the first predetermined liquid level. The second liquid level sensor 116 is operatively connected to the process control 66 for sending data to the process control. The second liquid level sensor 116 is also operatively connected to the emergency shutdown control 71 for direct emergency shutdown in the event of water levels exceeding the second predetermined liquid level.

A second control valve 118 is connected in fluid communication with the water separator 32 and the natural gas inlet 26. The second control valve 118 is operatively connected to the process control 66 and is responsive to data sent from the second liquid level sensor 116 to the process control 66. When the second predetermined liquid level is reached, the water separator 32 is in danger of being overcome by the liquid contaminants with catastrophic consequences. At this time, the process control 66 will close the second control valve 118 to shut off natural gas 24 to the water separator 32 and activate the emergency shutdown control to stop all gas flow through the system, thus precluding damage to the natural gas processing system 20.

A third liquid level sensor 120 is connected in fluid communication with the particulate filter 46 and senses a third predetermined liquid level in the particulate filter 46. The third liquid level sensor 120 is operatively connected to the process control 66 for sending data to the process control.

A third control valve 122 is connected in fluid communication with the particulate filter 46 and the liquid drain 30. The third control valve 122 is operatively connected to the process control 66, and is responsive to data sent from the third liquid level sensor 120 to the process control 66. When the third predetermined liquid level is reached, the process control 66 will open the third control valve 122 to drain liquid contaminants from the particulate filter 46. Natural gas 24 will continue to flow through the system during the draining process.

A fourth liquid level sensor 124 is connected in fluid communication with the particulate filter 46 and senses a fourth predetermined liquid level in the particulate filter 46 that is higher than the third predetermined liquid level. The fourth liquid level sensor 124 is operatively connected to the process control 66 for sending data to the process control 66. The fourth liquid level sensor 124 is also operatively connected to the emergency shutdown control 71 for direct emergency shutdown in the event of water levels exceeding the fourth predetermined liquid level.

A fourth control valve 126 is connected in fluid communication with the particulate filter 46 and the natural gas inlet 26. The fourth control valve 126 is operatively connected to the process control 66 and is responsive to data sent from the fourth liquid level sensor 124 to the process control 66. When the fourth predetermined liquid level is reached, the particulate filter 46 is in danger of being overcome by the liquid contaminants with catastrophic consequences. At this time, the process control 66 will close the fourth control valve 126 to shut off natural gas 24 to the particulate filter 46 and activate the emergency shutdown control to stop all gas flow through the system, thus precluding damage to the natural gas processing system 20.

The source natural gas 24 parameters at the natural gas inlet 26 are as follows. The natural gas processing system 20 is adapted to process the source natural gas 24 having a temperature range from 30° F. to 180° F., but is preferably from 40° F. to 120° F. The BTU composition can range from 1,100 BTU to 1,400 BTU, but is preferably from 950 BTU to 1800 BTU. The source natural gas 24 pressure can range from atmospheric pressure to 2400 PSIG, but is preferably from 50 PSIG to 1200 PSIG. The source natural gas 24 saturation levels are at typically at dewpoint.

Vent connections with associated piping are found on major components throughout the system. All vents typically bleed gases to the atmosphere through a relief valve.

It will be appreciated that variants of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

PARTS LIST

NATURAL GAS SYSTEM FOR ON-SITE PROCESSING

PART NO. DESCRIPTION

20 natural gas processing system 68 moisture analyzer
22 natural gas source 69 moisture sensor
24 natural gas 70 power supply
26 natural gas inlet 71 ESD control
28 mobile platform 72 ESD valve
29 enclosure 73 ESD switch
30 liquid drain 74 electrical cable
31 access doors 76 electrical cable tray
32 water separator 78 vessel support
36 source natural gas valve 80 temperature sensor low
38 first methane detector 81 temperature sensor high
40 second methane detector 82 flow analyzer
42 third methane detector 83 H2S analyzer
44 flame detector 84 gas analyzer
46 particulate filter 85 gas sensor
50 particulate filter bypass valve 86 outlet valve low
52 gas sampler 88 outlet valve high
54 gas outlet low 89 H2S sensor
56 gas outlet high 90 shutoff valve low
58 flow sensor low 92 shutoff valve high
60 flow sensor high 94 low pressure regulator
62 pressure relief valve 96 high pressure regulator
63 vent 97 pressure sensor upstream
64 thermoelectric generator 98 pressure sensor low
66 process control 99 pressure sensor high
100 HMI internal
102 keyboard internal
104 monitor internal
106 HMI external
108 keyboard external
110 monitor external
112 first liquid level sensor
114 first control valve
116 second liquid level sensor
118 second control valve
120 third liquid level sensor
122 third control valve
124 fourth liquid level sensor
126 fourth control valve The embodiments of the invention in which an exclusive property or privilege is claimed are defined as follows:

1. A natural gas processing system for use in connection with a natural gas source and raw source natural gas produced by the source, the natural gas processing system comprising:

a mobile platform adapted for being transported to the natural gas source;

a liquid drain juxtaposed with the mobile platform for discharging liquid contaminants from the natural gas processing system;

a source natural gas inlet connected in fluid communication with the natural gas source;

a source natural gas valve connected in fluid communication with the natural gas source for controlling the source natural gas entering the natural gas processing system;

a water separator mounted on the mobile platform, the water separator being connected in fluid communication with the source natural gas valve, the water separator being connected to the liquid drain, the water separator being adapted for removing water liquid from the natural gas, the water separator being adapted for allowing passage of the natural gas therethrough;

a particulate filter mounted on the mobile platform, the particulate filter being connected in fluid communication with the water separator and the liquid drain, the particulate filter being adapted for removing particulate matter from the natural gas, the particulate filter being adapted for allowing passage of the natural gas therethrough;

at least one natural gas outlet valve connected in fluid communication with the particulate filter for controlling the natural gas exiting the natural gas processing system;

at least one natural gas outlet connected in fluid communication with the at least one outlet valve;

a generator mounted on the mobile platform for supplying process electricity, wherein the generator being powered by the natural gas;

an emergency shutdown valve connected in fluid communication with the natural gas outlet;

a process control operatively connected to the natural gas processing system, and to the generator, and to the emergency shutdown valve, for controlling the natural gas processing system;

at least one emergency shutdown control operatively connected to the emergency shutdown valve and to the process control;

a gas sensor connected in fluid communication with the natural gas outlet, the gas sensor being operatively connected to the emergency shutdown control for direct emergency shutdown;

a gas analyzer positioned between the water separator and the natural gas outlet and operatively connected to the gas sensor and to the process control for sending data to the process control and to the emergency shutdown control;

wherein data from the gas analyzer that is sent to the process control does not inform the water separator functionality; and wherein data from the gas analyzer informs only the actuation of the emergency shutdown control; further comprising: at least one emergency shutdown control operatively connected to the emergency shutdown valve and to the process control; at least one temperature sensor connected in fluid communication with the natural gas outlet, the temperature sensor being operatively connected to the process control; and at least one pressure sensor connected in fluid communication with the natural gas outlet, the temperature sensor being operatively connected to the process control; further comprising: at least one flow sensor connected in fluid communication with the natural gas outlet; and at least one flow analyzer operatively connected to the flow sensor and to the process control, the flow analyzer being adapted for conveying data from the flow sensor to the process control; further comprising: a gas sensor connected in fluid communication with the natural gas outlet, the gas sensor being operatively connected to the emergency shutdown control for direct emergency shutdown; and a gas analyzer operatively connected to the gas sensor and to the process control for sending data to the process control; and wherein the gas analyzer is a gas chromatograph.

2. The natural gas processing system of claim 1, further comprising:

an H2S sensor connected in fluid communication with the natural gas outlet, the H2S sensor being operatively connected to the emergency shutdown control for direct emergency shutdown; and an H2S analyzer operatively connected to the H2S sensor and to the process control for sending data to the process control.

3. The natural gas processing system of claim 2, further comprising:

at least one moisture sensor connected in fluid communication with the natural gas outlet, the moisture sensor being operatively connected to the emergency shutdown control for direct emergency shutdown; and a moisture analyzer operatively connected to the moisture sensor and to the process control for sending data to the process control.

4. The natural gas processing system of claim 3, further comprising:

a first liquid level sensor connected in fluid communication with the water separator for sensing a first predetermined liquid level in the water separator, the first liquid level sensor being operatively connected to the process control for sending data to the process control;

a first control valve connected in fluid communication with the water separator and the liquid drain, the first control valve being operatively connected to the process control and responsive to data sent from the first liquid level sensor to the process control, so as to drain liquid contaminants from the water separator when the first predetermined liquid level is reached;

a second liquid level sensor connected in fluid communication with the water separator for sensing a second predetermined liquid level in the water separator that is higher than the first predetermined liquid level, the second liquid level sensor being operatively connected to the process control for sending data to the process control, the second liquid level sensor being operatively connected to the emergency shutdown control for direct emergency shutdown in the event of water levels exceeding the second predetermined liquid level;

a second control valve connected in fluid communication with the water separator and the natural gas inlet, the second control valve being operatively connected to the process control and responsive to data sent from the second liquid level sensor to the process control, so as to shut off natural gas to the water separator and activate the emergency shutdown control when the second predetermined liquid level is reached, thereby precluding damage to the natural gas processing system;

a third liquid level sensor connected in fluid communication with the particulate filter for sensing a third predetermined liquid level in the particulate filter, the third liquid level sensor being operatively connected to the process control for sending data to the process control;

a third control valve connected in fluid communication with the particulate filter and the liquid drain, the third control valve being operatively connected to the process control and responsive to data sent from the third liquid level sensor to the process control, so as to drain liquid contaminants from the particulate filter when the third predetermined liquid level is reached;

a fourth liquid level sensor connected in fluid communication with the particulate filter for sensing a fourth predetermined liquid level in the particulate filter that is higher than the third predetermined liquid level, the fourth liquid level sensor being operatively connected to the process control for sending data to the process control, the fourth liquid level sensor being operatively connected to the emergency shutdown control for direct emergency shutdown in the event of water levels exceeding the fourth predetermined liquid level; and a fourth control valve connected in fluid communication with the particulate filter and the natural gas inlet, the fourth control valve being operatively connected to the process control and responsive to data sent from the fourth liquid level sensor to the process control, so as to shut off natural gas to the particulate filter and activate the emergency shutdown control when the fourth predetermined liquid level is reached, thereby precluding damage to the natural gas processing system.

5. The natural gas processing system of claim 4, further comprising at least one pressure regulator connected in fluid communication with the at least one natural gas outlet.

6. The natural gas processing system of claim 4, wherein the at least one natural gas outlet further comprises:

a high natural gas outlet connected in fluid communication with the particulate filter for controlling the natural gas pressure at a predetermined pressure exiting the natural gas processing system;

a high natural gas outlet valve connected in fluid communication with the high natural gas outlet;

a low natural gas outlet connected in fluid communication with the particulate filter for controlling the natural gas pressure at a pressure less than the predetermined pressure exiting the natural gas processing system; and a low natural gas outlet valve connected in fluid communication with the low natural gas outlet.

7. The natural gas processing system of claim 6, wherein the at least one flow sensor further comprises:

a high flow sensor connected in fluid communication with the high natural gas outlet and operatively connected to the process control; and a low flow sensor connected in fluid communication with the low natural gas outlet and operatively connected to the process control.

8. The natural gas processing system of claim 6, wherein the at least one temperature sensor further comprises:

a high temperature sensor connected in fluid communication with the high natural gas outlet and operatively connected to the process control; and a low temperature sensor connected in fluid communication with the low natural gas outlet and operatively connected to the process control.

9. The natural gas processing system of claim 6, wherein the at least one pressure sensor further comprises:

a high pressure sensor connected in fluid communication with the high natural gas outlet and operatively connected to the process control; and a low pressure sensor connected in fluid communication with the low natural gas outlet and operatively connected to the process control.

10. The natural gas processing system of claim 6, further comprising:

a high pressure regulator connected in fluid communication with the high natural gas outlet; and a low pressure regulator connected in fluid communication with the low natural gas outlet.

11. The natural gas processing system of claim 1, wherein the processing system is adapted to process the source natural gas having the properties of:

a pressure range of from 50 PSIG to 1200 PSIG;

a temperature range of from 40° F. to 120° F.; and a BTU composition range from 1,100 BTU to 1,400 BTU; and wherein the source natural gas saturation levels are at dewpoint.

12. The natural gas processing system of claim 11, wherein the processing system is adapted to process the source natural gas having the properties of:

a pressure range of from atmospheric pressure to 2400 PSIG;

a temperature range of from 30° F. to 180° F.; and a BTU composition range from 950 BTU to 1800 BTU; and wherein the source natural gas saturation levels are at dewpoint.

13. The natural gas processing system of claim 1, wherein the mobile platform further comprises an enclosure, the enclosure being weather-resistant, the enclosure being adapted for enclosing the mobile platform and the natural gas processing system.

14. A natural gas processing system for use in connection with a natural gas source and raw source natural gas produced by the source, the natural gas processing system comprising:

a mobile platform adapted for being transported to the natural gas source;

a liquid drain juxtaposed with the mobile platform for discharging liquid contaminants from the natural gas processing system;

a source natural gas inlet connected in fluid communication with the natural gas source;

a source natural gas valve connected in fluid communication with the natural gas source for controlling the source natural gas entering the natural gas processing system;

a water separator mounted on the mobile platform, the water separator being connected in fluid communication with the source natural gas valve, the water separator being connected to the liquid drain, the water separator being adapted for removing water liquid from the natural gas, the water separator being adapted for allowing passage of the natural gas therethrough;

a particulate filter mounted on the mobile platform, the particulate filter being connected in fluid communication with the water separator and the liquid drain, the particulate filter being adapted for removing particulate matter from the natural gas, the particulate filter being adapted for allowing passage of the natural gas therethrough;

a high natural gas outlet connected in fluid communication with the particulate filter for controlling the natural gas pressure at a predetermined pressure exiting the natural gas processing system;

a high natural gas outlet valve connected in fluid communication with the high natural gas outlet;

a low natural gas outlet connected in fluid communication with the particulate filter for controlling the natural gas pressure at a pressure less than the predetermined pressure exiting the natural gas processing system;

a low natural gas outlet valve connected in fluid communication with the low natural gas outlet;

a thermoelectric generator mounted on the mobile platform for supplying process electricity, the thermoelectric generator being powered by the natural gas;

an emergency shutdown valve connected in fluid communication with the natural gas outlet;

a process control operatively connected to the natural gas processing system, and to the thermoelectric generator, and to the emergency shutdown valve, for controlling the natural gas processing system;

at least one emergency shutdown control operatively connected to the emergency shutdown valve and to the process control;

a gas sensor connected in fluid communication with the natural gas outlet, the gas sensor being operatively connected to the emergency shutdown control for direct emergency shutdown; and a gas analyzer positioned between the water separator and the natural gas outlet and operatively connected to the gas sensor and to the process control for sending data to the process control and to the emergency shutdown control;

wherein data from the gas analyzer that is sent to the process control does not inform the water separator functionality; and wherein data from the gas analyzer informs only the actuation of the emergency shutdown control; further comprising: at least one emergency shutdown control operatively connected to the emergency shutdown valve and to the process control; at least one temperature sensor connected in fluid communication with the natural gas outlet, the temperature sensor being operatively connected to the process control; and at least one pressure sensor connected in fluid communication with the natural gas outlet, the temperature sensor being operatively connected to the process control; further comprising: at least one flow sensor connected in fluid communication with the natural gas outlet; and at least one flow analyzer operatively connected to the flow sensor and to the process control, the flow analyzer being adapted for conveying data from the flow sensor to the process control; further comprising: a gas sensor connected in fluid communication with the natural gas outlet, the gas sensor being operatively connected to the emergency shutdown control for direct emergency shutdown; and a gas analyzer operatively connected to the gas sensor and to the process control for sending data to the process control; and wherein the gas analyzer is a gas chromatograph.

15. The natural gas processing system of claim 14, further comprising:

an H2S sensor connected in fluid communication with the natural gas outlet, the H2S sensor being operatively connected to the emergency shutdown control for direct emergency shutdown;

an H2S analyzer operatively connected to the H2S sensor and the process control, for sending data to the process control;

a moisture sensor connected in fluid communication with the natural gas outlet, the moisture sensor being operatively connected to the emergency shutdown control for direct emergency shutdown; and a moisture analyzer operatively connected to the moisture sensor and the process control, for sending data to the process control; wherein the gas analyzer, the H2S analyzer, and the moisture analyzer, are adapted for conveying data to the process control and to the emergency shutdown control.

16. The natural gas processing system of claim 15, further comprising:

a high flow sensor connected in fluid communication with the high natural gas outlet and operatively connected to the process control;

a low flow sensor connected in fluid communication with the low natural gas outlet and operatively connected to the process control;

a high temperature sensor connected in fluid communication with the high natural gas outlet and operatively connected to the process control;

a low temperature sensor connected in fluid communication with the low natural gas outlet and operatively connected to the process control;

a high pressure sensor connected in fluid communication with the high natural gas outlet and operatively connected to the process control; and a low pressure sensor connected in fluid communication with the low natural gas outlet and operatively connected to the process control.

17. The natural gas processing system of claim 16, further comprising:

a first liquid level sensor connected in fluid communication with the water separator for sensing a first predetermined liquid level in the water separator, the first liquid level sensor being operatively connected to the process control for sending data to the process control;

a first control valve connected in fluid communication with the water separator and the liquid drain, the first control valve being operatively connected to the process control and responsive to data sent from the first liquid level sensor to the process control, so as to drain liquid contaminants from the water separator when the first predetermined liquid level is reached;

a second liquid level sensor connected in fluid communication with the water separator for sensing a second predetermined liquid level in the water separator that is higher than the first predetermined liquid level, the second liquid level sensor being operatively connected to the process control for sending data to the process control and operatively connected to the emergency shutdown control for sending data to the emergency shutdown control;

a second control valve connected in fluid communication with the water separator and the natural gas inlet, the second control valve being operatively connected to the process control and responsive to data sent from the second liquid level sensor to the process control, so as to shut off natural gas to the water separator and activate the emergency shutdown control when the second predetermined liquid level is reached, thereby precluding damage to the natural gas processing system;

a third liquid level sensor connected in fluid communication with the particulate filter for sensing a third predetermined liquid level in the particulate filter, the third liquid level sensor being operatively connected to the process control for sending data to the process control;

a third control valve connected in fluid communication with the particulate filter and the liquid drain, the third control valve being operatively connected to the process control and responsive to data sent from the third liquid level sensor to the process control, so as to drain liquid contaminants from the particulate filter when the third predetermined liquid level is reached;

a fourth liquid level sensor connected in fluid communication with the particulate filter for sensing a fourth predetermined liquid level in the particulate filter that is higher than the third predetermined liquid level, the fourth liquid level sensor being operatively connected to the process control for sending data to the process control and operatively connected to the emergency shutdown control for sending data to the emergency shutdown control; and a fourth control valve connected in fluid communication with the particulate filter and the natural gas inlet, the fourth control valve being operatively connected to the process control and responsive to data sent from the fourth liquid level sensor to the process control, so as to shut off natural gas to the particulate filter and activate the emergency shutdown control when the fourth predetermined liquid level is reached, thereby precluding damage to the natural gas processing system.

18. The natural gas processing system of claim 17, further comprising:

a high pressure regulator connected in fluid communication with the high natural gas outlet; and a low pressure regulator connected in fluid communication with the low natural gas outlet.

* * * * *